US008983086B2

(12) United States Patent
Xin et al.

(10) Patent No.: US 8,983,086 B2
(45) Date of Patent: Mar. 17, 2015

(54) AUDIO OUTPUT CONTROLLER AND CONTROL METHOD

(75) Inventors: Yang Xin, Shenzhen (CN); Tsung-Jen Chuang, New Taipei (TW); Jun Zhang, Shenzhen (CN); Jun-Wei Zhang, Shenzhen (CN); Ren-Wen Huang, Shenzhen (CN); Qiang You, Shenzhen (CN)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 358 days.

(21) Appl. No.: 13/334,102

(22) Filed: Dec. 22, 2011

(65) Prior Publication Data

US 2013/0003985 A1 Jan. 3, 2013

(30) Foreign Application Priority Data

Jun. 29, 2011 (CN) ..... 2011 1 0178984

(51) Int. Cl.
*H04R 1/10* (2006.01)
*H04R 5/04* (2006.01)
*H04R 5/033* (2006.01)

(52) U.S. Cl.
CPC ..... *H04R 5/04* (2013.01); *H04R 5/033* (2013.01); *H04R 2420/05* (2013.01)
USPC ..... 381/74; 381/102; 381/104; 381/120; 381/123

(58) Field of Classification Search
CPC ..... H04R 5/033; H04R 5/04; H04R 3/12; H04R 3/14; H04R 1/1041; H04R 2420/09; H04R 2430/01; H04R 27/00; H04R 27/02; H04R 1/10; H04R 1/1008; H04R 1/1016; G06F 3/16; G06F 3/162; G06F 3/165; G06F 3/167
USPC ..... 381/104, 105, 106, 107, 108, 109, 110, 381/123, 74, 77, 80, 81, 84, 85, 92, 94.1, 381/94.5, 101, 72, 120; 455/3.06, 355
See application file for complete search history.

(56) References Cited

U.S. PATENT DOCUMENTS

| | | | | |
|---|---|---|---|---|
| 6,885,900 | B1 * | 4/2005 | Rybicki et al. | 700/94 |
| 7,519,185 | B2 * | 4/2009 | Liang | 381/74 |
| 7,953,231 | B2 * | 5/2011 | Ishida | 381/74 |
| 2001/0049566 | A1 * | 12/2001 | Kim | 700/94 |
| 2003/0099367 | A1 * | 5/2003 | Okamura | 381/77 |
| 2005/0265565 | A1 * | 12/2005 | Sakemoto et al. | 381/123 |
| 2006/0215848 | A1 * | 9/2006 | Ambourn | 381/74 |

(Continued)

*Primary Examiner* — Leshui Zhang
(74) *Attorney, Agent, or Firm* — Novak Druce Connolly Bove + Quigg LLP

(57) ABSTRACT

An output controller and an method for outputting a signal flow to one or more earphone jacks according to a connection status of each earphone jack. The output controller includes an interface unit having more than one earphone jacks and an output control unit. The output control unit includes a signal input terminal for receiving a signal flow, a detector, and a determining module. The detector detects whether each earphone jack is connected with an earphone and outputs one or more detected signals representing the connection status of the earphone jacks. The determining module outputs the signal flow directly to the connected earphone jack if only one earphone jack is connected to the earphone or distributes the signal flow being amplified correspondingly into each connected earphone jack if more than one earphone jack is connected to the earphones.

20 Claims, 3 Drawing Sheets

(56) References Cited

U.S. PATENT DOCUMENTS

2007/0015457 A1* 1/2007 Krampf et al. ..... 455/3.06
2007/0098184 A1* 5/2007 Ibe ..... 381/77
2007/0274530 A1* 11/2007 Buil et al. ..... 381/74
2007/0286436 A1* 12/2007 Isobe et al. ..... 381/107
2008/0003955 A1* 1/2008 Rutkowski et al. ..... 455/91
2009/0154720 A1* 6/2009 Oki ..... 381/74

* cited by examiner

AUDIO OUTPUT CONTROLLER AND CONTROL METHOD

TECHNICAL FIELD

The disclosure generally relates to audio playing technologies, and particularly, to afn audio output controller and an output control method.

DESCRIPTION OF RELATED ART

Many audio players only include one earphone jack. If more than one user wants to listen to the audio player at the same time, an adapter having more than one earphone jacks to distribute one signal flow output by the player into more than one signal sub-flows is needed. However, the power of each signal sub-flow is usually lower than the signal flow output by the media player. The user needs to manually adjust the output power of media player to ensure each earphone jack of the adapter can output normal volume, which is not convenient and results in low efficiency.

Therefore, it is desirable to provide an audio output controller and method which can overcome the above-mentioned problems.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
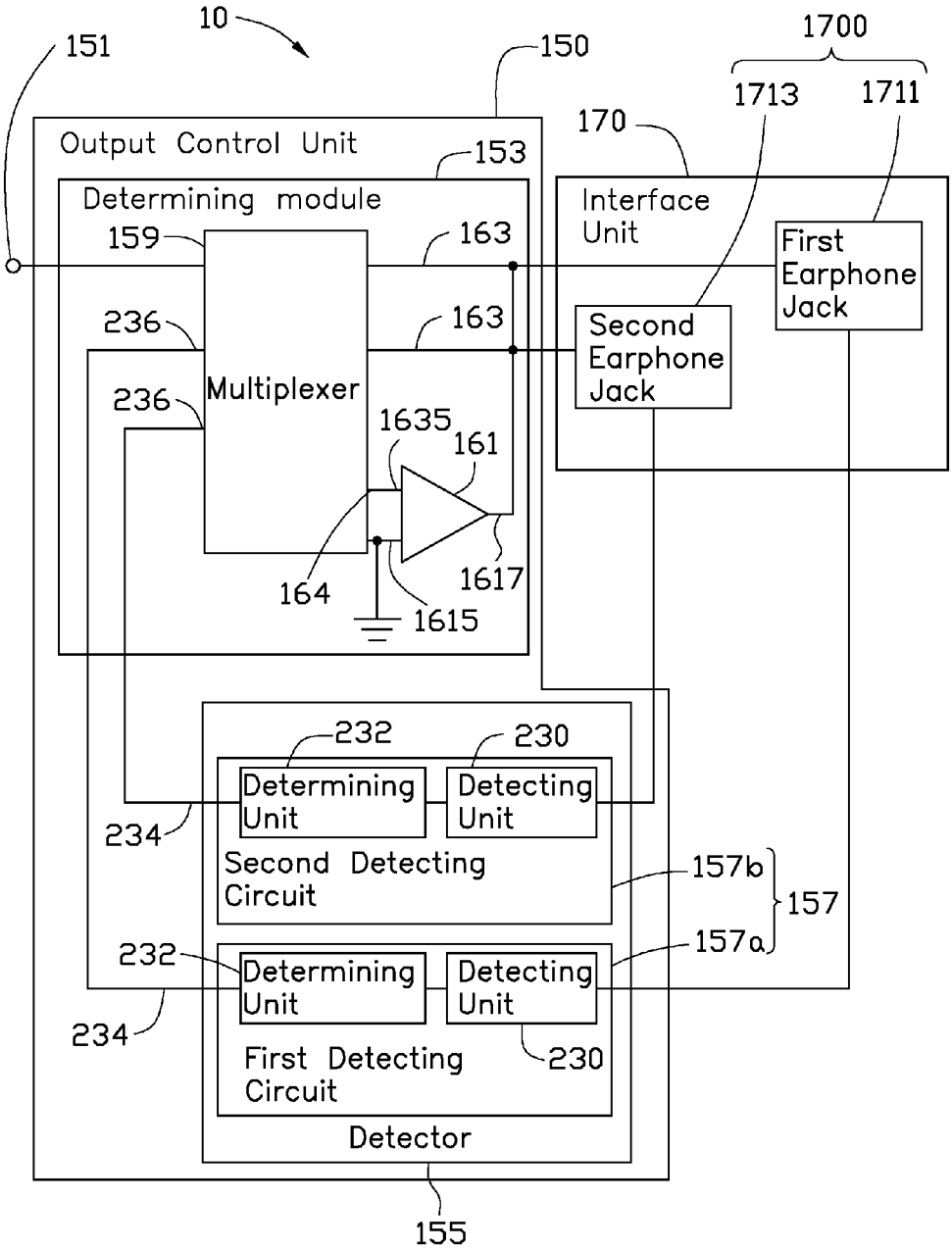
FIG. 1 is a block diagram of one embodiment of an audio output controller, the controller including a detecting circuit.

FIG. 1 is a block diagram of one embodiment of an audio controller 10, the audio controller 10 including a detecting circuit 157. In one embodiment, the audio controller 10 may include an output control unit 150 and an interface unit 170. The interface unit 170 includes more than one earphone jack 1700 that is capable of connecting with one or more than one earphones (not shown) at the same time. Each earphone jack 1700 includes at least two terminal pads 1701 (see FIG. 2) for outputting a signal. When the earphone connects with the earphone jack 1700, a connecting terminal of the earphone electrically contacts with the terminal pads 1701 to receive the signal. Thus, the terminal pads 1701 of the earphone jack 1700 are electrically connected with each other. In this embodiment, each earphone jack 1700 includes two terminal pads 1701 correspondingly named a first terminal pad 1701*a* and a second terminal pad 1701*b*. The output control unit 150 detects whether the earphone jack 1700 is connected with the earphone. The output control unit 150 is also configured for outputting a signal flow to the connected earphone jack 1700 if only one earphone jack 1700 is connected to the earphone or distributing a signal flow being amplified respectively into more than one signal sub-flows if more than one earphone jacks 1700 are connected to the earphones, and then transmitting the signal sub-flows respectively to each connected earphone jack 1700. The signal flow comes from an audio player (not shown), the signal flow can be a current flow or a voltage flow.

The output control unit 150 includes a detector 155 and a determining module 153. The detector 155 includes more than one detecting circuits 157. Each detecting circuit 157 respectively connects with one of the earphone jacks 1700 of the interface unit 170. Each detecting circuit 157 detects whether the corresponding earphone jack 1700 is connected to the earphone. In this embodiment, the interface unit 170 includes two earphone jacks 1700: a first earphone jack 1711 and a second earphone jack 1713. The detector 157 respectively includes a first detecting circuit 157*a* and a second detecting circuit 157*b*.

Figure 2:
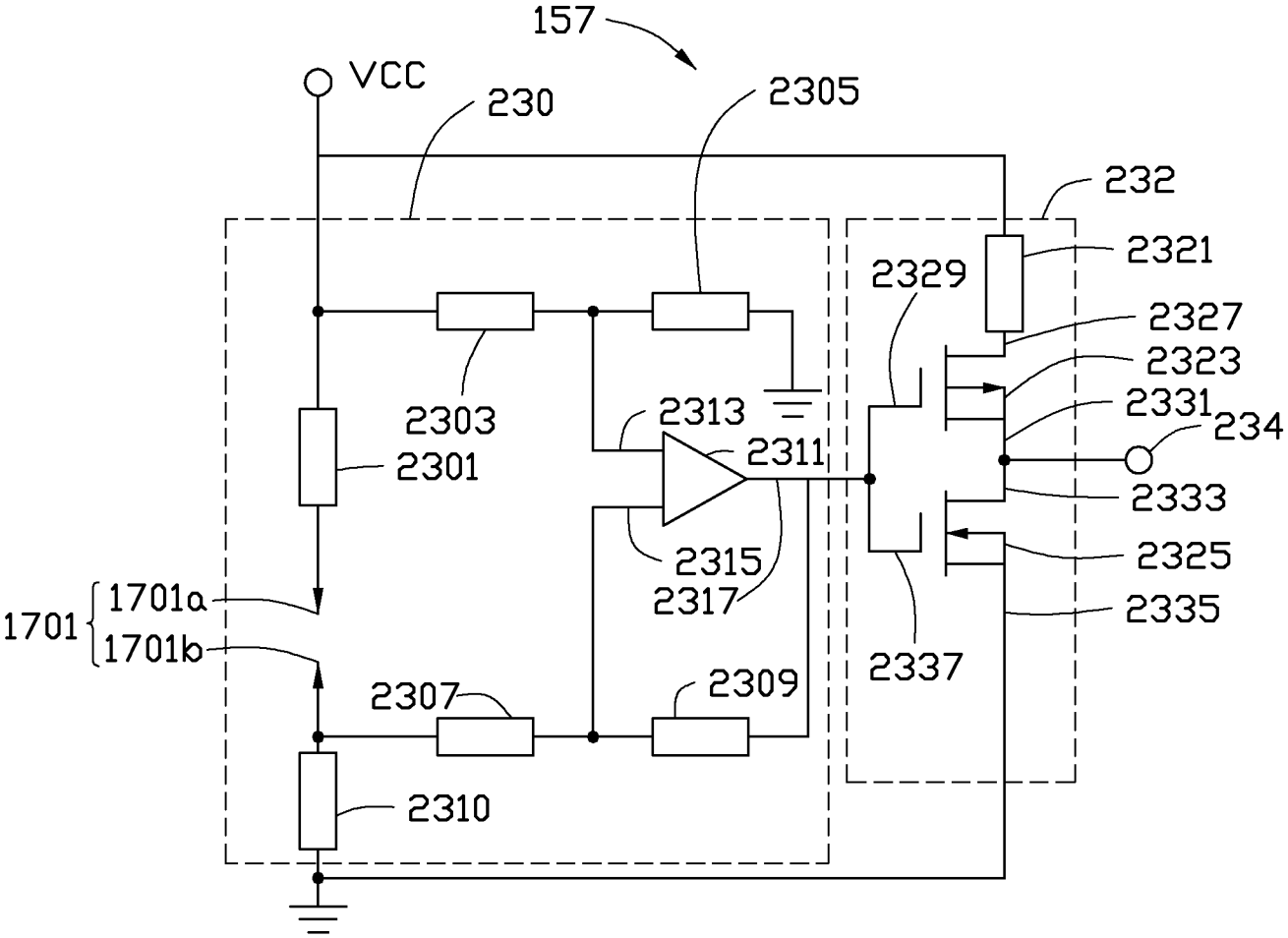
FIG. 2 is a circuit diagram of one embodiment of the detecting circuit of FIG. 1.

FIG. 2 is a diagram of one embodiment of the detecting circuit 157. Each detecting circuit 157 includes a detecting unit 230 and a determining unit 232. The detecting unit 230 respectively connects with the first terminal pads 1701*a* and the second terminal pad 1701*b* to detect whether the earphone jack 1700 is connected to the earphone and transmits a status signal representing the connection status of the earphone jack 1700 to the determining unit 232. The determining unit 232 generates a detecting signal according to the status signal from the detecting unit 230 and transmits the detecting signal to the determining module 153.

In detail, the detecting unit 230 includes a first operational amplifier 2311, a first resistor 2301, a second resistor 2303, a third resistor 2305, a fourth resistor 2307, a fifth resistor 2309, and a seventh resistor 2310. The first operational amplifier 2311 includes a first input terminal 2313, a second input terminal 2315, and an output terminal 2317. The first terminal pad 1701*a* connects with a power source VCC via the first resistor 2301. The power source VCC ground via the second resistor 2303 and the third resistor 2305 connected in series. The first input terminal 2313 is connected to a node between the second resistor 2303 and the third resistor 2305. The output terminal 2317 connects with the second terminal pad 1701*b* via the fifth resistor 2309 and the fourth resistor 2307 which are connected in series. The second terminal 1701*b* is grounded via the seventh resistor 2310. The second input terminal 2315 is connected to a second node between the fourth resistor 2307 and the fifth resistor 2309. In this embodiment, the first input terminal 2313 is a non-inverting input terminal of the first operational amplifier 2311, the second input terminal 2315 is an inverting input terminal of the first operational amplifier 2311.

The determining unit 232 includes a first transistor 2323, a second transistor 2325, and a sixth resistor 2321. The first transistor 2323 includes a first control terminal 2329, a first conducting terminal 2327, and a second conducting terminal 2331. The second transistor 2325 includes a second control terminal 2337, a third conducting terminal 2333, and a fourth conducting terminal 2335. The first control terminal 2329 and the second control terminal 2337 are connected to the output terminal 2317. The first conducting terminal 2327 is connected to the power source VCC via the sixth resistor 2321. The second conducting terminal 2331 is connected to the third conducting terminal 2333. The fourth conducting terminal 2335 is grounded. A node between the second conducting terminal 2331 and the third conducting terminal 2333 is defined as a detecting output terminal 234 of the detecting circuit 157. In this embodiment, the first transistor 2323 is a P-type transistor. The first control terminal 2329 is a source electrode of the P-type transistor. The first conducting terminal 2327 is a gate electrode of the P-type transistor. The second conducting terminal 2331 is a drain electrode of the P-type transistor. The second transistor 2325 is a N-type transistor. The second control terminal 2337 is a source electrode of the N-type transistor. The third conducting terminal 2333 is a gate electrode of the N-type transistor. The fourth conducting terminal 2335 is a drain electrode of the N-type transistor.

The determining module 153 includes a multiplexer 159 and a second operational amplifier 161. The multiplexer 159 includes a signal input terminal 151, more than one detecting input terminals 236, more than one normal output terminals 163, and an amplifying output terminal 164. The signal input terminal 151 connects with a player for receiving an signal flow. Each detecting input terminal 236 respectively connects with the detecting output terminal 234 of each detecting circuit 157 for receiving a detecting signal output by the detecting circuit 157. Each normal output terminal 163 respectively connects with one of earphone jacks 1700 of the interface unit 170 for transmitting the signal flow not being amplified to the corresponding earphone jack 1700. The amplifying output terminal 164 connects with an input terminal 1635 of the second operational amplifier 161. The other input terminal 1615 of the second operational amplifier 161 is grounded. The output terminal 1617 of the second operational amplifier 161 connects with each earphone jack 1700 for transmitting the signal flow being amplified to each earphone jack 1700. In this embodiment, the multiplexer 159 includes two detecting input terminals 263 corresponding to the first detecting circuit 157*a* and the second detecting circuit 157*b* and two normal output terminals 163 corresponding to the first earphone jack 1711 and the second earphone jack 1713. The amplifying output terminal 1617 connects with both the first earphone jack 1711 and the second earphone jack 1713.

For explanation, the resistance of the first resistor 2301 is named as R1, the resistance of the second resistor 2303 is named as R2, the resistance of the third resistor 2305 is named as R3, the resistance of the seventh resistor 2310 is named as R. The voltage of the first input terminal 2313 of the first operational amplifier 2311 is named as U1. The voltage of the second input terminal 2315 of the first operational amplifier 2311 is named as U2. The voltage of the output terminal 2317 of the first operational amplifier 2311 is named as U0. The voltage of the power source VCC is named as VCC. Therefore, the output voltage of the first operational amplifier 2311 can be represented as a formula: $Uo=R3/R2(U1-U2)$.

In operation, when the earphone jack 1700 is connected to the earphone, the first terminal pad 1701*a* is electrically connected to the second terminal pad 1701*b* via the connecting terminal of the earphone. The first operational amplifier 2311 operates a subtraction. Therefore, $U1=VCC$, $U2=[R/(R+R1)]*VCC$, U0 is a low voltage. The first transistor 2323 is turned on. The detecting circuit 157 outputs a high level detecting signal to the determining module 153 via the detecting output terminal 236. The high level detecting signal is represented as "H".

When the earphone jack 1700 is not connected to the earphone, the electrical connection between the first terminal pad 1701*a* and the second terminal 1701*b* is cut off. Therefore, $U1=VCC$, $U2=0$, U0 is a high voltage. The second transistor 2325 is turned on. The detecting circuit 157 outputs a low level detecting signal to the determining module 153 via the detecting output terminal 236. The low level detecting signal is represented as "L".

The multiplexer 159 run a logic operation according to the input detecting signals to determine which detecting output terminal 163 to output the signal flow to. In this embodiment, the result of the logic operation as shown below:

| detecting signal from the first detecting output terminal | detecting signal from the second detecting output terminal | output terminal |
|---|---|---|
| L | L | None |
| L | H | The second normal output terminal |
| H | L | The first normal output terminal |
| H | H | The amplifying output terminal |

From the list above, when the first earphone jack 1711 connects with the earphone and the second earphone jack 1713 does not connect with the earphone, the signal flow is transmitted to the first earphone jack 1711 via the first normal output terminal 163. When the second earphone jack 1713 connects with the earphone and the first earphone jack 1711 does not connect with the earphone, the signal flow is transmitted to the second earphone jack 1713 via the second normal output terminal 163. When the first earphone jack 1711 and the second earphone jack 1713 connect with the earphones at a same time, the signal flow is distributed into the first earphone jack 1711 and the second earphone jack 1713 after being amplified by the second operational amplifier 161. Therefore, each signal sub-flow sent to the first earphone jack 1711 or the second earphone jack 1713 can remain at normal power of the original signal flow.

Figure 3:
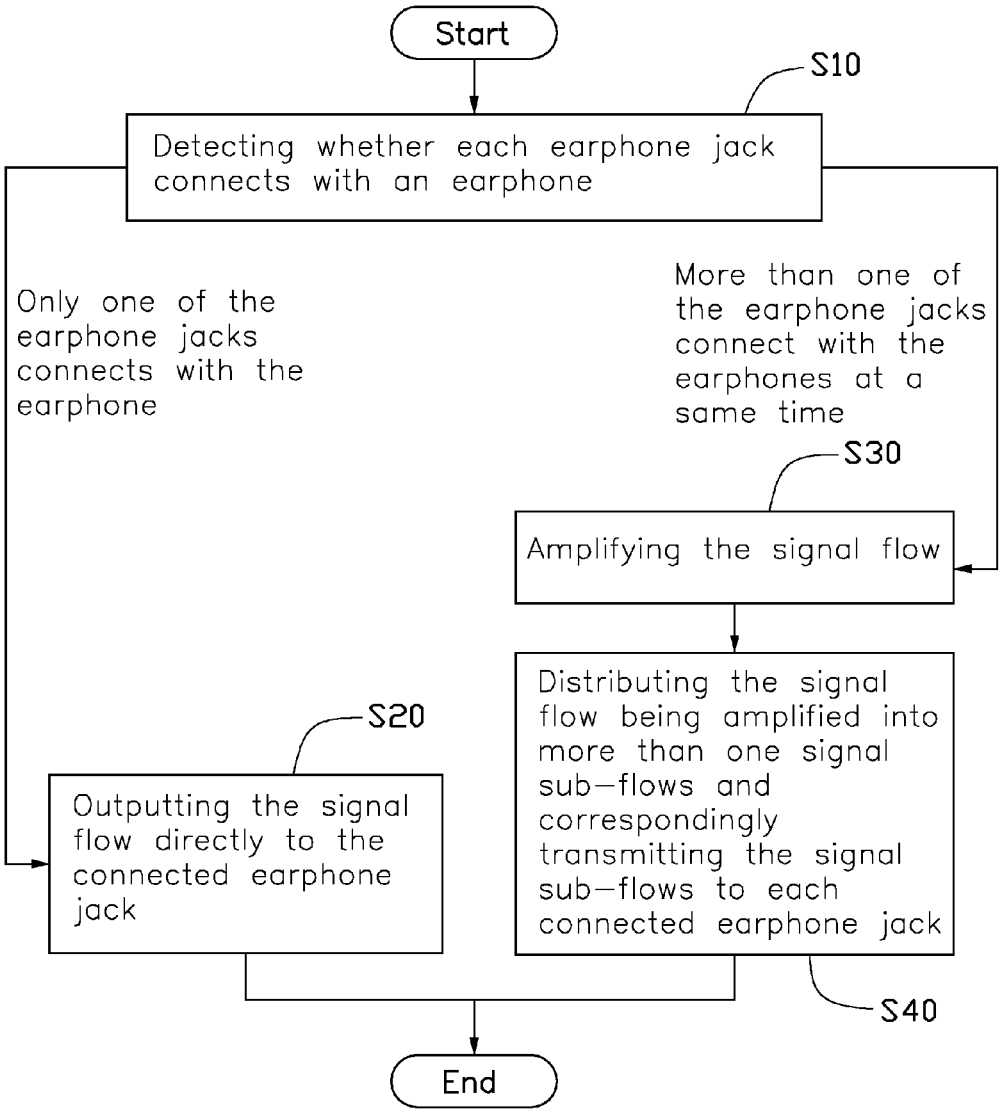
FIG. 3 is a flowchart of one embodiment of an output control method.

FIG. 3 is a flowchart of one embodiment of an output control method for automatically outputting a signal flow to one or more than one earphone jacks 1700 according to the connection status of each earphone jack 1700. Depending on the embodiment, additional steps may be added, others omitted, and the ordering of the steps may be changed.

In step S10, each detecting circuit 157 of the detector 155 detects whether each earphone jack 1700 connects with an earphone and outputs a detecting signal representing the connection status of each earphone jack 1700 to the determining module 153.

In step S20, if only one of the earphone jacks 1700 is connected with the earphone, the determining module 153 outputs the signal flow directly to the connected earphone jack 1700 according to the detecting signal from the detecting circuit 157.

In step S30, if more than one of the earphone jack 1700 is connected with the earphones at the same time, the determining module 153 amplifies the signal flow via the second operational amplifier 161.

In step S40, the determining module 153 distributes the signal flow being amplified into more than one signal sub-flows, and correspondingly transmits the signal sub-flows to each connected earphone jack 1700.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. An audio output controller, comprising:

an interface unit comprising more than one earphone jacks to be connected with earphones; and an output control unit comprising:

an audio signal input terminal configured for receiving an audio signal flow;

a detector configured for detecting whether each earphone jack of the more than one earphone jacks connects with an earphone of the earphones and outputting a detecting signal representative of a connection status of the more than one earphone jacks; and a determining module configured for receiving the detecting signal and performing according to the received detecting signal if only one earphone jack of the more than one earphone jacks is connected to the earphone, outputting the audio signal flow directly to the connected earphone jack and if the more than one earphone jacks are connected to the earphones, accordingly amplifying the audio signal flow to produce an amplified audio signal flow and distributing the amplified audio signal flow into each of the connected more than one earphone jacks.

2. The audio output controller of claim 1, wherein the each earphone jack comprises at least two terminal pads for outputting the audio signal flow, when the each earphone jack connects with the earphone, the terminal pads are electrically connected with each other via the earphone.

3. The audio output controller of claim 2, wherein the detector comprises more than one detecting circuits, each of the more than one detecting circuits correspondingly connects with one of the more than one earphone jacks.

4. The audio output controller of claim 3, wherein each of the more than one detecting circuits comprises a detecting unit, the detecting unit correspondingly connects with the terminal pads to detect whether the more than one earphone jack connects with the earphone and generates a status signal representative of the connection status of the more than one earphone jack.

5. The audio output controller of claim 4, wherein the detecting unit comprises a first operational amplifier, a first resistor, a second resistor, a third resistor, a fourth resistor, a fifth resistor, and a seventh resistor, the first operational amplifier comprises a first input terminal, a second input terminal, and an output terminal, one of the at least two terminal pads connects with a power source via the first resistor, the power source grounds via the second resistor and the third resistor connected in series, the first input terminal is connected to a node between the second resistor and the third resistor, the output terminal connects with the other terminal pad via the fourth resistor and the fifth resistor connected in series, the second input terminal is connected to a second node between the fourth resistor and the fifth resistor and grounds via the seventh resistor.

6. The audio output controller of claim 5, wherein the first input terminal is a non-inverting input terminal of the first operational amplifier, the second input terminal is an inverting input terminal of the first operational amplifier.

7. The audio output controller of claim 5, wherein each of the more than one detecting circuits further comprises a determining unit, the determining unit generates the detecting signal according to the status signal from the detecting unit and transmits the detecting signal to the determining module.

8. The audio output controller of claim 7, wherein the determining unit comprises a first transistor, a second transistor, and a sixth resistor, the first transistor comprises a first control terminal, a first conducting terminal, and a second conducting terminal, the second transistor comprises a second control terminal, a third conducting terminal, and a fourth conducting terminal, the first control terminal of the first transistor and the second control terminal of the first transistor are connected to the output terminal of the first operational amplifier, the first conducting terminal of the first transistor is connected to the power source via the sixth resistor, the second conducting terminal of the first transistor is connected to the third conducting terminal of the second transistor, the fourth conducting terminal of the second transistor is grounded, a node between the second conducting terminal of the first transistor and the third conducting terminal of the second transistor is defined as a detecting output terminal of each of the more than one detecting circuits.

9. The audio output controller of claim 8, wherein the determining module comprises a multiplexer, the multiplexer comprises more than one detecting input terminals, more than one normal output terminals, and an amplifying output terminal, each detecting input terminal of the more than one detecting input terminals correspondingly connects with the detecting output terminal of each of the more than one detecting circuits to receive the detecting signal outputted by the detecting circuit of the more than one detecting circuits, each normal output terminal of the more than one normal output terminals correspondingly connects with one of the more than one earphone jacks for transmitting the audio signal flow not being amplified to the corresponding earphone jack of the more than one earphone jacks, the normal output terminal of the more than one normal output terminals outputs the audio signal flow not being amplified to the corresponding earphone jack of the more than one earphone jacks when the detecting circuit of the more than one detecting circuits connected to the earphone jack of the more than one earphone jacks outputs a high level detecting signal to the multiplexer.

10. The audio output controller of claim 9, wherein the determining module further comprises a second operational amplifier, the amplifying output terminal of the multiplexer connects with an input terminal of the second operational amplifier, the other input terminal of the second operational amplifier grounds, an output terminal of the second operational amplifier connects with each of the more than one earphone jacks, the amplifying output terminal of the multiplexer outputs the amplified audio signal flow to the more than one earphone jacks when the more than one detecting circuits connected to the more than one earphone jacks output the high level detecting signal to the multiplexer.

11. A control method for outputting an audio signal flow to one or more than one earphone jacks according to a connection status of each of the one or more than one earphone jacks, the method comprising:

detecting whether each of the one or more than one earphone jacks connects with an earphone;

if only one of the one or more than one earphone jacks connects with the earphone, outputting the audio signal flow directly to the connected earphone jack;

if more than one of the one or more than one earphone jacks connect with more than one earphones at a same time, accordingly amplifying the audio signal flow to produce an amplified audio signal flow;

distributing the amplified audio signal flow into more than one audio signal sub-flows; and correspondingly transmitting the more than one audio signal sub-flows to each of the connected more than one earphone jacks.

12. The method as claimed in claim 11, wherein each of the one or more than one earphone jacks comprises at least two terminal pads for outputting the audio signal flow, when each of the one or more than one earphone jacks connects with the earphone, at least two terminal pads are electrically connected with each other via the connected earphone.

13. The method as claimed in claim 12, wherein the connection status of each of the one or more than one earphone jacks is correspondingly detected by a detecting circuit connected to the one or more than one earphone jacks.

14. The method as claimed in claim 13, wherein the detecting circuit comprises a detecting unit, the detecting unit correspondingly connects with the at least two terminal pads to detect whether the one or more than one earphone jacks connects with the earphone and generate a status signal representing the connection status of the one or more than one earphone jacks.

15. The method as claimed in claim 14, wherein the detecting unit comprises a first operational amplifier, a first resistor, a second resistor, a third resistor, a fourth resistor, a fifth resistor, and a seventh resistor, the first operational amplifier comprises a first input terminal, a second input terminal, and an output terminal, one of the at least two terminal pads connects with a power source via the first resistor, the power source grounds via the second resistor and the third resistor connected in series, the first input terminal is connected to a node between the second resistor and the third resistor, the output terminal connects with the other terminal pad via the fourth resistor and the fifth resistor connected in series, the second input terminal is connected to a second node between the fourth resistor and the fifth resistor and grounds via the seventh resistor.

16. The method as claimed in claim 15, wherein the first input terminal is a non-inverting input terminal of the first operational amplifier, the second input terminal is an inverting input terminal of the first operational amplifier.

17. The method as claimed in claim 15, wherein the detecting circuit further comprises a determining unit, the determining unit generates a detecting signal according to the status signal from the detecting unit.

18. The method as claimed in claim 17, wherein the determining unit comprises a first transistor, a second transistor, and a sixth resistor, the first transistor comprises a first control terminal, a first conducting terminal, and a second conducting terminal, the second transistor comprises a second control terminal, a third conducting terminal, and a fourth conducting terminal, the first control terminal of the first transistor and the second control terminal of the second transistor are connected to the output terminal of the first operational amplifier, the first conducting terminal of the first transistor is connected to the power source via the sixth resistor, the second conducting terminal of the first transistor is connected to the third conducting terminal of the second transistor, the fourth conducting terminal of the second transistor is grounded, a node between the second conducting terminal of the first transistor and the third conducting terminal of the second transistor is defined as a detecting output terminal of the detecting circuit.

19. The method as claimed in claim 18, wherein the audio signal flow is output to the one or more than one earphone jacks by a determining module, the determining module comprises a multiplexer, the multiplexer comprises more than one detecting input terminals and more than one normal output terminals, each detecting input terminal of the more than one detecting input terminals correspondingly connects with the detecting output terminal of the detecting circuit to receive the detecting signal outputted by the detecting circuit, each of the more than one normal output terminals correspondingly connects with one of the one or more than one earphone jacks for transmitting the audio signal flow not being amplified to the corresponding one of the one or more than one earphone jacks, the one of the more than one normal output terminals outputs the audio signal flow not being amplified to the corresponding the one of the one or more than one earphone jacks when the detecting circuit connected to the one or more than one earphone jacks outputs a high level detecting signal to the multiplexer.

20. The method as claimed in claim 19, wherein the determining module further comprises a second operational amplifier and an amplifying output terminal, the amplifying output terminal connects with an input terminal of the second operational amplifier, the other input terminal of the second operational amplifier grounds, the output terminal of the second operational amplifier connects with each of the one or more than one earphone jacks, the amplifying output terminal of the determining module outputs the amplified audio signal flow to the one or more than one earphone jacks when the detecting circuit connected to the one or more than one earphone jacks outputs the high level detecting signal to the multiplexer.

* * * * *